US011549216B2

(12) United States Patent
Pomeroy et al.

(10) Patent No.: US 11,549,216 B2
(45) Date of Patent: Jan. 10, 2023

(54) OIL/GREASE RESISTANT PAPER PRODUCTS

(71) Applicant: SAPPI NORTH AMERICA, INC., Boston, MA (US)

(72) Inventors: Paige Allison Case Pomeroy, Falmouth, ME (US); Alonzo K. Osgood, Portland, ME (US); Thomas A. Waecker, Cape Elizabeth, ME (US); Arbin Rajbanshi, Gorham, ME (US)

(73) Assignee: SAPPI NORTH AMERICA, INC., Boston, MA (US)

( * ) Notice: Subject to any disclaimer, the term of this patent is extended or adjusted under 35 U.S.C. 154(b) by 213 days.

(21) Appl. No.: 16/949,693

(22) Filed: Nov. 11, 2020

(65) Prior Publication Data

US 2022/0145543 A1 May 12, 2022

(51) Int. Cl.

| | |
|---|---|
| ***D21H 17/68*** | (2006.01) |
| ***D21H 19/60*** | (2006.01) |
| ***D21H 19/64*** | (2006.01) |
| ***D21H 21/16*** | (2006.01) |

(52) U.S. Cl.

CPC ..... *D21H 19/60* (2013.01); *D21H 17/68* (2013.01); *D21H 19/64* (2013.01); *D21H 21/16* (2013.01)

(58) Field of Classification Search

CPC ..... D21H 19/826; D21H 17/68; D21H 19/82; D21H 27/10; D21H 21/16; D21H 19/822; D21H 19/64; D21H 19/60

USPC ..... 162/119

See application file for complete search history.

(56) References Cited

U.S. PATENT DOCUMENTS

| | | | |
|---|---|---|---|
| 3,097,989 | A | 7/1963 | Hill et al. |
| 4,391,833 | A | 7/1983 | Self et al. |
| 4,909,901 | A | 3/1990 | McAllister et al. |
| 5,147,505 | A | 9/1992 | Altman |
| 5,244,541 | A | 9/1993 | Minton |
| 5,660,898 | A | 8/1997 | Calvert |
| 5,728,224 | A | 3/1998 | Laurent et al. |
| 5,776,619 | A | 7/1998 | Shanton |
| 5,897,411 | A | 4/1999 | Stark et al. |
| 5,932,068 | A | 8/1999 | Farrington et al. |
| 6,030,497 | A | 2/2000 | Watkins, Jr. |
| 6,680,084 | B1 | 1/2004 | Chtourou |
| 7,001,661 | B2 | 2/2006 | Beaverson et al. |
| 7,045,036 | B2 | 5/2006 | Lipponen et al. |
| 7,144,632 | B2 | 12/2006 | Hayes |
| 7,244,505 | B2 | 7/2007 | Kippenhahn et al. |
| 7,320,825 | B2 | 1/2008 | Morabito |
| 7,358,325 | B2 | 4/2008 | Hayes |
| 7,641,764 | B2 | 1/2010 | Yoshida et al. |
| 7,833,915 | B2 | 11/2010 | Propst, Jr. |
| 7,909,962 | B2 | 3/2011 | Urscheler |
| 8,021,517 | B2 | 9/2011 | Hughes et al. |
| 8,048,266 | B2 | 11/2011 | Katajamaki et al. |
| 8,216,665 | B2 | 7/2012 | Farchione |
| 9,200,409 | B2 | 12/2015 | Hartmann et al. |
| 9,334,610 | B2 | 5/2016 | Kinnunen et al. |
| 9,771,688 | B2 | 9/2017 | Pang et al. |
| 9,849,655 | B2 | 12/2017 | Huang et al. |
| 9,908,144 | B2 | 3/2018 | Salminen et al. |
| 9,986,757 | B2 | 6/2018 | Griesmayr et al. |
| 10,214,316 | B2 | 2/2019 | Nevalainen et al. |
| 10,253,458 | B2 | 4/2019 | Pang et al. |
| 10,364,533 | B2 | 7/2019 | Heiskanen et al. |
| 10,378,153 | B2 | 8/2019 | Karlsson et al. |
| 10,399,744 | B2 | 9/2019 | Nevalainen |
| 10,519,604 | B2 | 12/2019 | Pang et al. |
| 10,704,200 | B2 | 7/2020 | Pang et al. |
| 2008/0107912 | A1 | 5/2008 | Barcock |
| 2008/0171213 | A1 | 7/2008 | Robben et al. |
| 2008/0190576 | A1 | 8/2008 | Champ et al. |
| 2009/0098303 | A1 | 4/2009 | Murphy et al. |
| 2010/0086746 | A1 | 4/2010 | Kersnick et al. |
| 2011/0027601 | A1 | 2/2011 | Ruffner, Jr. et al. |
| 2011/0088931 | A1 | 4/2011 | Lei et al. |

(Continued)

FOREIGN PATENT DOCUMENTS

| | | | |
|---|---|---|---|
| CA | 2625840 | A1 | 5/2007 |
| EP | 0042716 | A1 | 12/1981 |

(Continued)

OTHER PUBLICATIONS

International Application No. PCT/US 2021/045562, International Search Report and Written Opinion, dated Nov. 24, 2021, 10 Pages.

(Continued)

*Primary Examiner* — Mark Halpern

(74) *Attorney, Agent, or Firm* — Celia H. Leber; Leber IP Law

(57) ABSTRACT

Oil and grease resistant paper products are disclosed that include a substrate and, on at least one side of the substrate, a continuous layer of a barrier coating, the barrier coating comprising a binder system and a pigment. The barrier coating, when applied to the substrate and dried to form a barrier layer, has a Pigment Volume Concentration (PVC) that is below a Critical Pigment Volume Concentration (CPVC) of the barrier coating, providing a continuous three-dimensional film of the binder system. In some implementations the binder system comprising a latex and a natural binder and/or the paper product further includes a topcoat disposed on a side of the barrier coating opposite the substrate.

31 Claims, 6 Drawing Sheets

(56) References Cited

U.S. PATENT DOCUMENTS

| | | | | |
|---|---|---|---|---|
| 2011/0262745 | A1 | 10/2011 | Ronka | |
| 2012/0028016 | A1 | 2/2012 | Zuercher et al. | |
| 2012/0251597 | A1 | 10/2012 | Gupta et al. | |
| 2013/0209708 | A1* | 8/2013 | Gane | B05D 1/36 427/209 |
| 2013/0273353 | A1 | 10/2013 | Ting et al. | |
| 2013/0299113 | A1 | 11/2013 | Nordstrom | |
| 2014/0000823 | A1 | 1/2014 | Salminen | |
| 2016/0153149 | A1 | 6/2016 | Mongrain | |
| 2016/0288469 | A1 | 10/2016 | Schleiss et al. | |
| 2017/0356135 | A1 | 12/2017 | Biza et al. | |
| 2018/0135252 | A1 | 5/2018 | Pang et al. | |
| 2018/0142418 | A1 | 5/2018 | Sundholm et al. | |
| 2018/0171560 | A1 | 6/2018 | Heiskanen et al. | |
| 2018/0327976 | A1 | 11/2018 | Bhardwaj et al. | |
| 2019/0003125 | A1 | 1/2019 | Chen et al. | |
| 2019/0127917 | A1 | 5/2019 | Pang et al. | |
| 2019/0145049 | A1 | 5/2019 | Nevalainen | |
| 2019/0218429 | A1 | 7/2019 | Huang et al. | |
| 2019/0291134 | A1 | 9/2019 | Mongrain | |
| 2019/0376234 | A1 | 12/2019 | Mallya | |
| 2019/0390407 | A1 | 12/2019 | Knauf et al. | |
| 2020/0062474 | A1 | 2/2020 | Nobes | |
| 2020/0109517 | A1 | 4/2020 | Pang et al. | |
| 2020/0149222 | A1 | 5/2020 | Pang et al. | |
| 2020/0232164 | A1 | 7/2020 | Parker et al. | |

FOREIGN PATENT DOCUMENTS

| | | | |
|---|---|---|---|
| EP | 0078560 | A1 | 5/1983 |
| EP | 0611846 | A1 | 8/1994 |
| EP | 1416088 | B1 | 2/2010 |
| EP | 1416087 | B1 | 9/2010 |
| EP | 2402167 | A1 | 1/2012 |
| EP | 1411168 | B1 | 4/2016 |
| EP | 3186442 | A1 | 7/2017 |
| EP | 3363947 | A1 | 8/2018 |
| EP | 3084075 | B1 | 9/2018 |
| EP | 3286378 | B1 | 4/2019 |
| GB | 1479716 | A | 7/1977 |
| NZ | 244494 | A | 10/1994 |
| WO | 1997015402 | A1 | 5/1997 |
| WO | 2001046303 | A2 | 6/2001 |
| WO | 2001046303 | A3 | 6/2001 |
| WO | 2005044469 | A1 | 5/2005 |
| WO | 2006070064 | A1 | 7/2006 |
| WO | 2007050964 | A1 | 5/2007 |
| WO | 2010123689 | A1 | 10/2010 |
| WO | 2013182757 | A4 | 12/2013 |
| WO | 2013189550 | A1 | 12/2013 |
| WO | 2018189698 | A1 | 10/2018 |
| WO | 2018200790 | A1 | 11/2018 |
| WO | 2018229333 | A1 | 12/2018 |
| WO | 2019077514 | A1 | 4/2019 |
| WO | 2019086761 | A1 | 5/2019 |
| WO | 2019166929 | A1 | 9/2019 |
| WO | 2019171279 | A1 | 9/2019 |
| WO | 2020121162 | A1 | 6/2020 |

OTHER PUBLICATIONS

O'Neill, et al.—"Development of a Coating to Prevent Oil Migration through Board", PaperCon Apr. 22-25, 2012, New Orleans, Louisiana, USA, pp. 1669-1681.

O'Neill, et al.—"Hyper Platey Minerals Facilitate the Use of Water Base Barrier Coatings", p. 1682-1704, PaperCon Apr. 22-25, 2012, New Orleans, Louisiana, USA.

Vaha-Nissi, et al. "Filled Barrier Dispersion Coatings", Tampere University of Technology, Paper Converting Institute, Finland, retrieved as early as Mar. 8, 2021,17 pages.

Pal et al., "Shape Engineered Pigments Based Barrier Coatings for SBS Paperboard", 2007 International Conference on Nanotechnology for the Forrest Products Industry, Jun. 13-15, 2007, Knoxville, Tennessee, USA, pp. 1-34.

* cited by examiner

OIL/GREASE RESISTANT PAPER PRODUCTS

BACKGROUND

Conventionally, oil and grease resistance has been achieved in paper products, such as paper and paperboard, by the application of fluorinated substances to the fiber matrix or the surface of the fiber substrate. Due to concerns with human health and environmental effects of fluorinated substances, it is desirable to develop new technologies to achieve good oil and grease resistance without the use of these materials. Several decades of paper coating research has focused on developing coatings which can impart oil and grease resistance to paper and paperboard substrates, even after the paper or paperboard is folded or scored or creased. The solutions proposed in the literature generally fall into two main groups. The first group consists of barrier coatings which have very high levels of polymers, with or without crosslinking, which generally cannot be applied using conventional paper coating equipment without creating processing and converting issues. The second group consists of coatings which are formulated to mitigate the processing issues associated with the first group by utilizing appreciable levels of filler materials, at the detriment of oil and grease resistance performance. Another approach that is currently used is to provide polyethylene extruded coatings as a post-processing step to impart barrier properties. This, however, creates downstream problems including non-repulpability.

SUMMARY

The present disclosure features paper products, e.g., papers and paperboards, that exhibit grease and oil resistance while still being suitable for production on conventional paper coating equipment and having excellent printability and other characteristics that are desirable for paper products such as foldability and glueability. In some implementations, the paper products exhibit excellent resistance to blocking during manufacture (adhesion of the paper to itself when spooled) and high repulpability during and after manufacture, minimizing waste and allowing the paper products to be manufactured in an economically viable manner.

According to one aspect, the invention features a paper product that includes a substrate; and, on at least one side of the substrate, a continuous layer of a barrier coating, the barrier coating comprising a binder system, the binder system comprising a latex and a natural binder, and a pigment, wherein the barrier coating, when applied to the substrate and dried to form a barrier layer, has a Pigment Volume Concentration (PVC) that is below a Critical Pigment Volume Concentration (CPVC) of the barrier coating, providing a continuous three-dimensional film of the binder system.

In some implementations, the paper product includes one or more of the following features. The paper product may include a topcoat disposed on the surface of the barrier layer. The topcoat may have a PVC that is above a CPVC of the topcoat. The barrier coating may include from about 40 to 750 parts of the binder system per 100 parts pigment by weight. The paper product may exhibit >99% repulpability. The topcoat may include a pigment blend comprising an ultrafine clay and a ground calcium carbonate. The paper product may further include a precoat disposed between the substrate and the barrier layer. The precoat may include a pigment blend comprising a platy pigment and a coarse pigment with an average particle size of at least about 2 The paper product may be free of fluorocarbon-containing materials. The product may exhibit substantially no blocking during manufacture. The storage modulus on the TMA curve of the latex in the barrier coating may be less than 50 MPa, e.g., less than 30 MPa, at room temperature (25° C.).

In another aspect, the invention features a paper product comprising a substrate; on at least one side of the substrate, a continuous layer of a barrier coating, the barrier coating comprising a binder system and a pigment, and, a topcoat disposed on a side of the barrier coating opposite the substrate, wherein the barrier coating, when applied to the substrate and dried to form a barrier layer, has a Pigment Volume Concentration (PVC) that is below a Critical Pigment Volume Concentration (CPVC) of the barrier coating, providing a continuous three-dimensional film of the binder system.

In some implementations, the paper product includes one or more of the following features. The topcoat may include a pigment blend comprising ultrafine clay and/or ultrafine ground calcium carbonate. The topcoat may further include coarser pigment. The ratio of the finer pigment to the coarser pigment may be from about 1:10 to 10:1. The ground calcium carbonate may have a particle size distribution in which 90% of the particles are finer, or smaller, than 2 μm. The topcoat may include a natural binder, e.g., starch.

The invention also features methods of making the paper products disclosed herein. For example, the invention features a method of making a paper product comprising: (a) applying, to at least one side of a substrate, a continuous layer of a barrier coating, the barrier coating comprising a binder system, the binder system comprising a latex and a natural binder, and a pigment, (b) drying the barrier coating to form a barrier layer, the dried barrier layer having a Pigment Volume Concentration (PVC) that is below a Critical Pigment Volume Concentration (CPVC) of the barrier coating, providing a continuous three-dimensional film of the binder system, and (c) applying a topcoat to the barrier layer.

In some implementations, the method includes one or more of the following features. The topcoat is a graphical topcoat, e.g., a topcoat designed for graphical printing applications. The method further comprises calendering the topcoat. The method further comprises applying a precoat to the substrate prior to applying the barrier coating, on the same side of the substrate. In any of the steps above, applying is performed using a non-contact coater.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

DETAILED DESCRIPTION

The present disclosure features paper products that include at least one barrier coating, which is configured to provide oil and grease resistance without the need for the paper product to include any fluorocarbon-containing materials.

The barrier coating includes a relatively high level of binders, which causes the barrier coating to have a relatively low Pigment Volume Concentration (PVC) (the volume percentage of pigment in the composition, i.e., (Pigment volume)/(Pigment volume+Binder volume)) that is below the Critical Pigment Volume Concentration (CPVC). As is known in the coating art, the CPVC is normally defined as the PVC where there is just sufficient binder to provide a completely adsorbed layer of binder on the pigment surfaces and to fill all the interstices between the particles in a close-packed system. This feature, along with properties of the latex that will be discussed in detail below, provides a continuous barrier coating film, preferably one with no detectable voids, that has good grease and oil resistance as well as foldability and other desirable properties.

In the implementations described in detail below, the paper products typically exhibit at least 95% repulpability, and in some cases 99% or higher repulpability, measured by the Fiber Box Association Repulpability Test Procedure, Appendix A. A paper is repulpable if it can be recycled by reasonable means common to the paper industry through the pulp stage and be reformed into paper that is comparable to paper made from virgin wood pulp (i.e., wood pulp that has not previously been in the form of paper). A very high level of repulpability is generally necessary for a papermaking process to be commercially viable; however, coating formulations having a high level of latex tend to reduce the repulpability of the paper product to which they are applied. In the barrier coatings described herein this issue is addressed by the barrier coating formulation. The materials in the barrier coating formulation and their relative concentrations in the coating will be discussed further below.

In preferred implementations, the paper product also includes a topcoat layer, applied to the surface of the barrier coating. The topcoat is formulated to prevent blocking during manufacturing and provide good printability as well as convertability into a packaging product.

As will be discussed below, the paper products may optionally also include other coating layers, for example one or more precoat layers between the substrate and the barrier coating, additional topcoat layers, additional layers of barrier coating, and/or coatings on the opposite side of the substrate. Examples of such arrangements will now be discussed, but it will be apparent to the person of ordinary skill in the art that many other combinations may be used, including arrangements with more or fewer layers.

Paper Products

Figure 1:
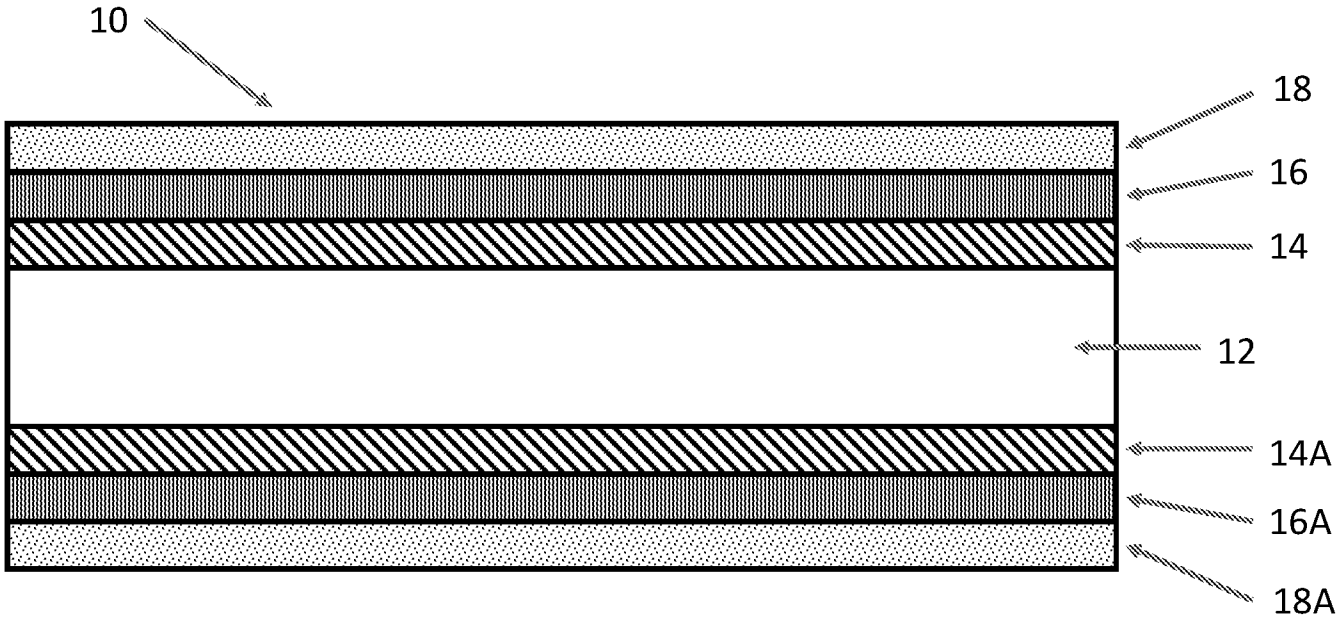
FIG. 1 is a highly enlarged diagrammatic cross-sectional view of a paper according to one implementation.

Referring to FIG. 1, in one implementation a paper product 10 includes a substrate 12 (e.g., a paper base sheet) that is coated on a first side with a precoat 14, a barrier coating 16, and a topcoat designed for printing 18, and on a second, opposite side with a precoat 14A, a barrier coating 16A, and a topcoat designed for printing 18A. Any or all of the coatings on the second side can be of a different formulation and/or a different coating weight from those on the first side. The arrangement shown in FIG. 1 can be advantageous, for example, in applications in which grease/oil resistance is required on one side of the paper product and moisture resistance or other barrier properties are required on the opposite side and printability and/or an aesthetically pleasing surface finish (provided by the topcoat) is desired on both sides. In such an application different formulations could be used for barrier coating 16 and barrier coating 16A to provide the desired barrier properties.

Figure 2A:
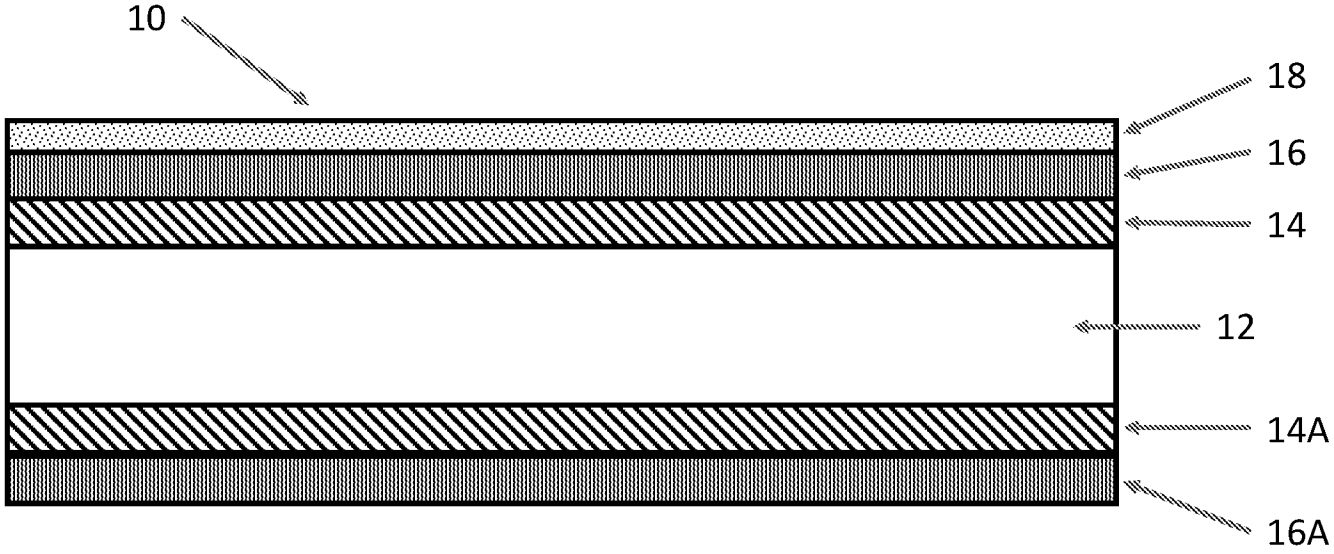
FIG. 2A is a highly enlarged diagrammatic cross-sectional view of a paper according to another implementation.

Referring to FIG. 2A, in another implementation the three coatings 14, 16 and 18 are provided on a first side of the substrate 12, but on the second, opposite side the topcoat 18A is omitted. This arrangement would be useful, for example, in an application where barrier properties are required on both sides, but only one side will be visible to the end user (or will be printed on).

Figure 2B:
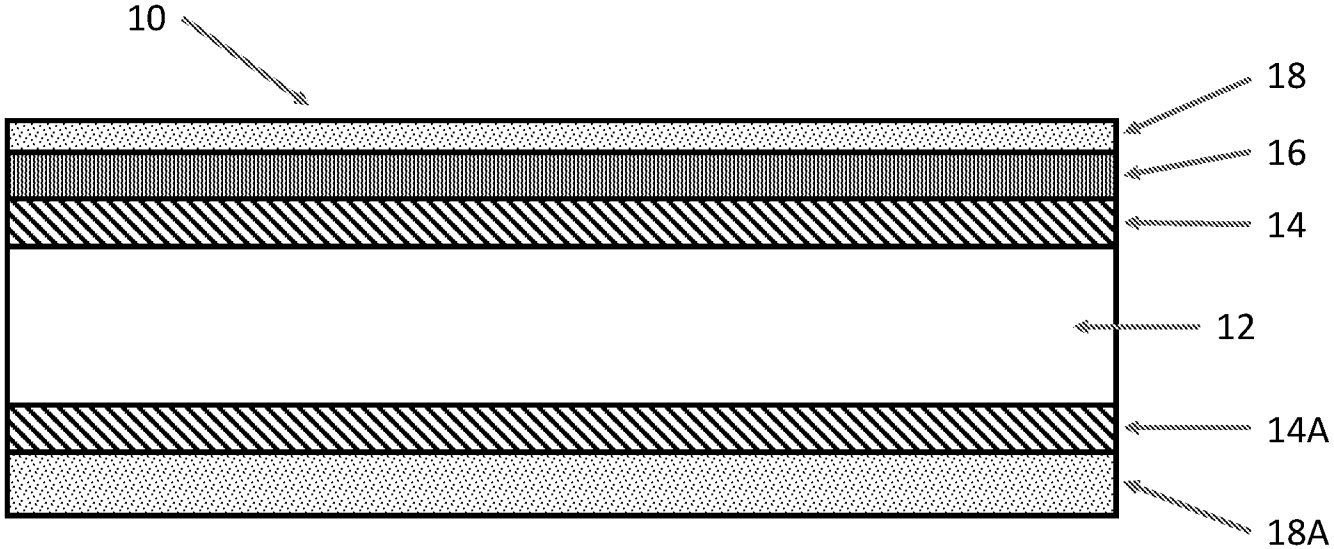
FIG. 2B is a highly enlarged diagrammatic cross-sectional view of a paper according to yet another implementation.

Referring to FIG. 2B, in another implementation the three coatings 14, 16 and 18 are provided on a first side of the substrate 12, but on the second, opposite side the barrier coating 16A is omitted. This arrangement would be useful, for example, in an application where barrier properties are required on only one side, but printable surfaces are desirable on both sides.

Figure 3:
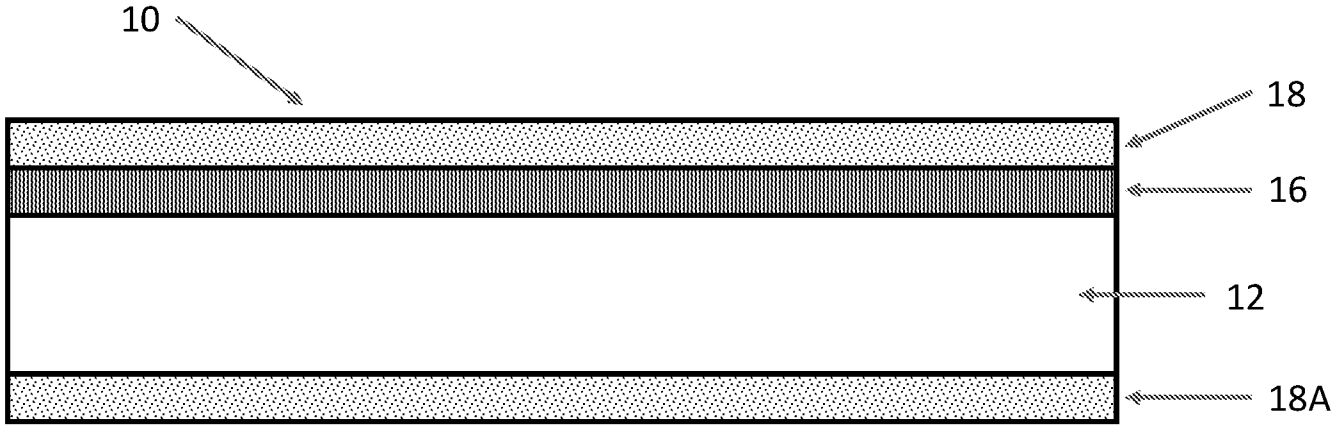
FIG. 3 is a highly enlarged diagrammatic cross-sectional view of a paper according to yet another implementation.

In some implementations the precoat layer(s) can be omitted, for example if the substrate itself provides a suitable surface for application of the barrier coating, as will be discussed in more detail below, or the barrier layer is applied at a higher coat weight than would be used if a precoat is included. An example of such an arrangement is shown in FIG. 3, in which a first side of the substrate 12 includes a barrier coating 16 and a topcoat 18, and the second, opposite side includes only a topcoat 18A. The two topcoats may be the same or different. This arrangement would be used, for example, in applications in which only one type of barrier layer (with a given set of barrier properties) is required in the paper product, but printability is required on both sides.

Figure 4:
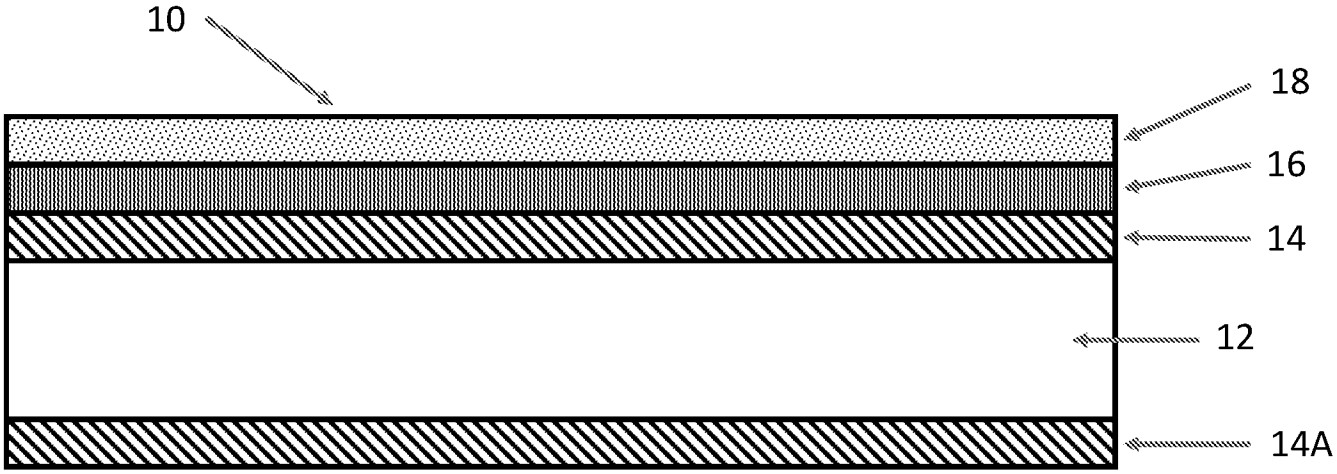
FIG. 4 is a highly enlarged diagrammatic cross-sectional view of a paper according to yet another implementation.

Another example of a paper product with a barrier layer on only one side is shown in FIG. 4. In this implementation, a first side of the substrate 12 includes all three layers (precoat 14, barrier coating 16, and topcoat 18), while a second side of the substrate includes only a precoat 14A. This arrangement would be suitable in applications in which only one type of barrier layer is needed, and printability is only required on one surface. The precoat 14A provides a relatively smooth surface, protects the fibers of the substrate 12, and prevents curl for proper printing and converting.

As noted above, many other variations are possible, including the use of multiple precoat layers beneath the barrier layer (which may reduce the amount of barrier coating needed by providing a smoother surface for application of the barrier coating).

Coating Formulations

In order for the three coatings discussed above to be used together on one side of a substrate, and applied using conventional paper making equipment, certain formulation properties are required. This is particularly the case when it is desired that the side of the paper carrying the barrier coating have good printability. For example, it is important that the coating formulations of adjacent coating layers be compatible, and that a coating be runnable on the underlying coating or substrate. In the paper products described herein, it is important in particular for the barrier coating to be able to form a continuous film on the underlying precoat or substrate (if a precoat is not used). It is also important that the topcoat be runnable on the underlying barrier coating without issues such as skip coat, reticulation, or cracking/ delamination of the topcoat from the barrier coating after drying. For good printability, it is also necessary that the topcoat be dryable without creating printing mottle, e.g., backtrap mottle, taking into account that, due to the presence of the barrier coating, water in the topcoat will not be able to migrate into the substrate. Also, the topcoat should be substantially free of streaks, drags and scratches after drying, which is partly determined by process parameters and/or coating application methods—as will be discussed below in the Process section—but is also a factor of the coating formulation. How these objectives are achieved will be discussed below in the context of each coating formulation. It is noted that the term "parts," as used herein, means parts on a dry solids weight basis, and, as is well known in the art, parts are based on 100 parts of pigment.

Precoat

As discussed above, the precoat is optional, and can be omitted if other techniques are used to obtain the desired continuity of the barrier coating layer (for example starting with a very smooth substrate, as will be discussed below, using a high coating weight of barrier coating, or using a continuous non-contact coating method, for example curtain coating or an air knife).

When a precoat is used, its main purpose is to fill voids and roughness in the substrate, providing a smooth layer for application of the barrier coating. This improves the holdout of the barrier coating and allows a thinner layer of the generally more expensive barrier coating to be used.

The precoat generally includes a binder system (a latex and/or a natural binder), and a pigment or pigment blend.

The latex preferably has sufficient flexibility to provide a desired degree of foldability to the product. The latex used in the precoat preferably has the same degree of flexibility as that used in the barrier coating, and may in some cases be the same latex. However, because the precoat contains a higher ratio of pigment to binder, the effect of the latex on the properties of the precoat is not as pronounced and it is not as important that the latex be flexible. Thus, latexes imparting lesser degrees of flexibility may be used without unduly affecting foldability. Foldability is typically measured by creasing the paper product (a 180-degree bend) and observing whether there is any cracking of the coating layers that is visible to the naked eye.

Suitable latexes include, for example, styrene butadiene, styrene butadiene acrylonitrile, styrene acrylic, styrene acrylate, styrene acrylate acrylonitrile, styrene butadiene acrylate, polyvinyl acetate, vinyl acetate ethylene, and mixtures thereof. Latexes can be tested and their performance evaluated based on the desired flexibility and foldability characteristics for a particular application. The latex used in the precoat may be the same as or different from the latex used in the barrier coating, as long as the latexes are sufficiently chemically compatible for the barrier coating to be runnable on the precoat and so that the layers do not delaminate from each other upon drying.

The natural binder may be, for example, starches and modified starches, proteins (e.g., soy protein, casein), carboxymethyl cellulose, hydroxymethyl cellulose, alginates, and mixtures thereof. The natural binder helps to avoid premature drying of the precoat due to the water in the coating sinking into the pores of the substrate. Too little of the natural binder may result in premature drying, while too much may cause cracking in the paper product. If latex is omitted, or a high level of natural binder is used, the natural binder should be selected to provide flexibility to the precoat layer. For example, starches that provide this degree of flexibility include highly modified starches like hydroxyethyl starch, hydroxypropyl starch, acetylated starch, octenyl succinic anhydride starch and the like. Starch systems may also be used, for example blends of starches with plasticizers such as humectants (e.g., polyols, glycerin, urea and the like).

The binder system for the precoat may also include polyvinyl alcohol (either synthetically or naturally derived) to provide flexibility and repulpability.

The pigment blend may include one or more pigments, such as clays, including platy clays, talc, and calcium carbonate, that will provide holdout and improve runnability. A platy clay can be used to bridge and fill large pores in the substrate (if the substrate includes large pores), which improves the smoothness and holdout of the substrate and thus contributes to runnability of the barrier coating on the precoat. If a platy clay is used, it is generally preferred that the platy clay has an aspect ratio of from about 10 to 80, e.g., about 15 to 40. Examples of suitable platy clays are Capim™ NP (commercially available from Imerys Kaolin), Astra-Plate™ (commercially available from Imerys), Kaowhite C (commercially available from Thiele), and Hydramatte® (commercially available from KaMin LLC). It is noted that if the substrate is relatively smooth and dense, as will be discussed in the Substrate section below, a platy clay may not be necessary. The purpose of the platy clay is simply to provide a relatively smooth surface to facilitate formation of a continuous film of the barrier coating without the need to apply a high coat weight of the barrier coating.

The pigment blend may also include calcium carbonate, for example a coarse calcium carbonate such as Hydrocarb® 60, commercially available from Omya North America, or Carbital™ 60, commercially available from Imerys. The coarse calcium carbonate provides tooth, to aid in cleaning of the metering blade during application of the barrier coating, which helps to prevent scratches in the barrier layer. It is generally preferred that about 3-40%, e.g., 10-20%, of the total pigment be a relatively coarse pigment to provide coatability (tooth), and about 3-60%, e.g., 20-50%, of the total pigment be a platy pigment to fill/bridge voids. The remainder of the pigment used can be an additional pigment having a finer particle size. The additional pigment may be, for example, any of the many pigments conventionally used in paper coatings (e.g., $TiO_2$, PCC, clays, plastic pigments, aluminum trihydrate, barium sulfate, fine calcium carbonate, talc, etc.). Examples of suitable filler pigment are fine calcium carbonates such as Hydrocarb® 90, commercially available from Omya North America, or Carbital™ 90, commercially available from Imerys. The main objective in selecting pigments is to obtain a smooth surface with some degree of tooth to which the barrier coating can be applied, to help facilitate formation of a continuous, void-free film of the barrier coating.

While the pigment blends described above are helpful in providing an advantageous surface for application of the barrier layer if the uncoated substrate is rough and/or porous (e.g., a high caliper paperboard base sheet), in some cases a single pigment may be used. For example, if the substrate is smoother and/or denser and less porous (e.g., a lower basis weight paper substrate rather than a paperboard substrate) a pigment blend is generally not necessary. In this case, the pigment may be, for example, any of the pigments typically used in paper precoats.

In some implementations, the precoat contains from about 10 to 30 parts of the binder system, e.g., from 5 to 20 parts latex and from 0 to 30 parts natural binder preferably modified for flexibility, per 100 parts of the pigment blend. Typical additives included in paper coatings may be added, e.g., dispersing agents and additives for viscosity control, pH control, microbiological control, foam control, water retention and shade control.

Barrier Coating

The barrier coating, which is essential as it provides the required oil/grease resistance, contains latex, starch and pigment. The Pigment Volume Concentration and the ratio of latex to starch are both important to obtaining the desired balance of properties, as are the properties of the latex and the starch.

Figure 5:
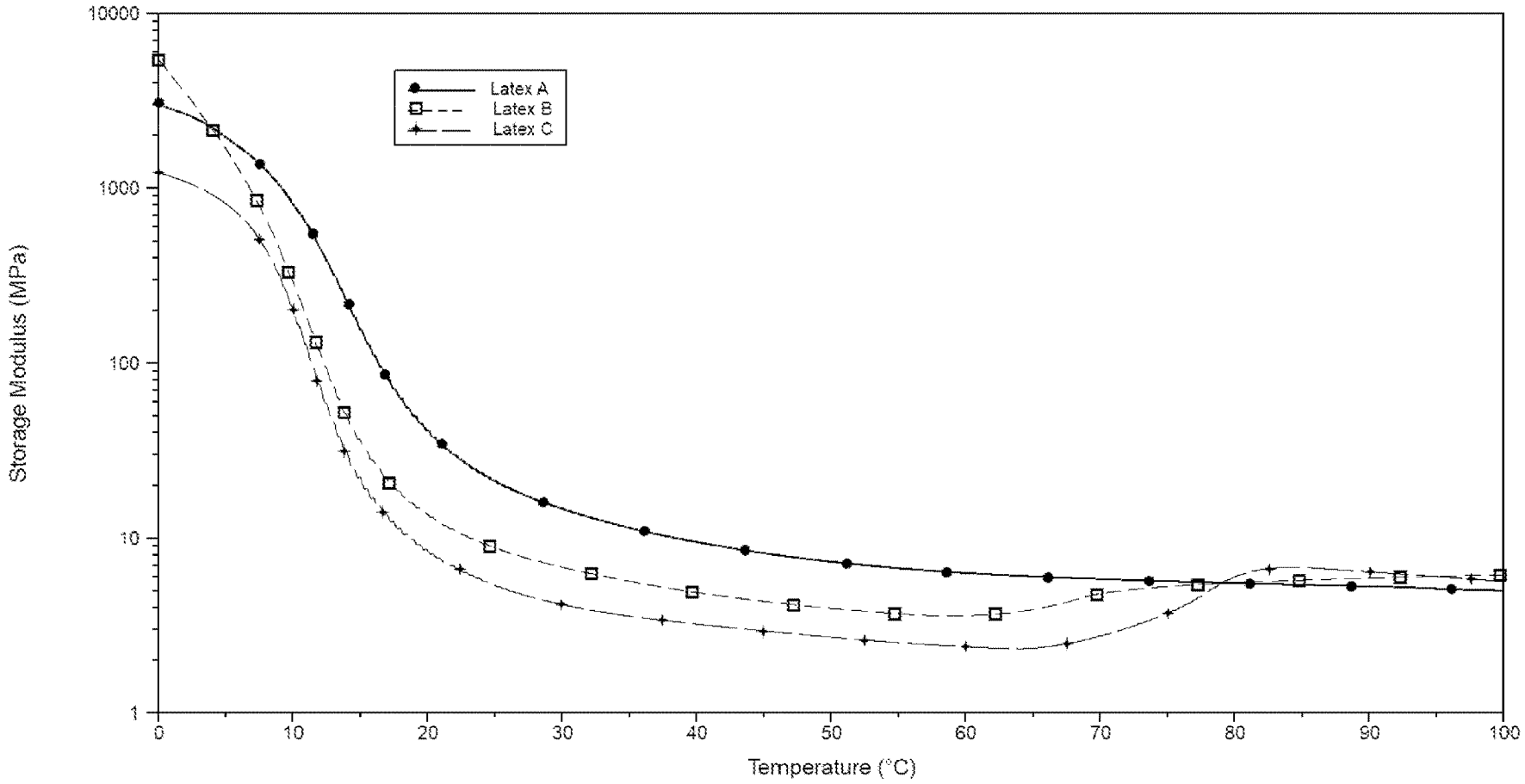
FIG. 5 is a TMA graph showing TMA curves for suitable latexes for use in the barrier coatings described herein.

Referring to FIG. 5, in preferred implementations the storage modulus on the TMA curve of the latex is less than 50 MPa and preferably less than 30 MPa, e.g., about 10 MPa to 30 MPa, at room temperature (25° C.). For this to be the case, the glass transition temperature ($T_g$) is generally below 20° C. These characteristics provide flexibility and toughness that impart foldability and durability to the paper product. These properties are important when the paper product is to be folded (e.g., for cartons or similar end products) or subjected to rough handling during manufacture, shipment or use of an end product. Good foldability also prevents the loss of barrier properties at creases or folds in the paper product.

The TMA curves shown in FIG. 5 were obtained as follows: The latexes were poured onto shallow aluminum weigh boats and allowed to dry at room temperature conditions. Once fully dry, the films were peeled off the weigh boats and small disks approximately 5 mm in diameter were randomly punched out of the films with a punching tool, avoiding voids. Testing to obtain storage modulus values was carried out on a Thermal Analysis (TA) Q400 thermomechanical analyzer (TMA). Each test is performed on a single disk. A quartz penetration probe was used to analyze the dry latex samples. The experimental procedure was based on the dynamic penetration experiment template that was pre-loaded on the TMA's software. Latex samples were loaded into the machine at room temperature, cooled to −10° C., and then heated at 3 deg/min to 180° C. The oscillation frequency and force of the penetration probe varied among the latexes in order to get the best resolution of data. The sample chamber was continuously purged with helium gas during testing.

The starch aids in repulpability by allowing the barrier film to break into small pieces during repulping. The starch also enhances the water-holding capacity of the coating during metering. Suitable starches include, for example, ethylated starches, propylated starches, acetylated starches, octenyl succinic anhydride (OSA) starches, thermally-modified starches, enzyme-converted starches and other starches typically used in paper coatings. In some implementations, the starches described in U.S. patent application Ser. Nos. 16/221,108 and 16/220,578 may be used. The entire disclosure of each of these patent applications is incorporated by reference herein. Starches with relatively high levels of modification and water plasticization would generally be preferred. Suitable starches for a particular application can be determined empirically by evaluating various modified starches in a given barrier coating formulation and testing the resulting coated paper products, e.g., for foldability, barrier properties and repulpability.

In some implementations, the ratio of latex to starch is from about 5:1 to 1:1. If too little starch is used, the repulpability of the paper product will tend to be reduced, while if too much starch is used the barrier properties of the barrier coating may be deleteriously affected.

The barrier coating may also include polyvinyl alcohol (either synthetically or naturally derived) as a binder component to provide flexibility and repulpability, e.g., from 2 to 250 parts, preferably 10 to 100 parts. Polyvinyl alcohol may be used in addition to the latex and starch and/or it may replace a portion of the starch.

The pigment is selected to provide runnability of the barrier coating without scratching and repulpability of the barrier layer (and thus of the paper product). The pigment is also selected to provide runnability of the topcoat over the barrier layer with minimal scratching when using contact metering systems. It is also important that the pigment not have a negative effect on barrier properties, e.g., by allowing grease or oil to penetrate through the layer. For example, Hydrocarb® 90, Carbital™ 90, or other calcium carbonate having a particle size distribution with at least 90% of the particles less than 2 would be suitable for this purpose. Fine and ultrafine clays, such as Hydragloss® 90 and Kaofine 90, would also be suitable. The particle size of the pigment should be sufficiently small such that pigment particles do not protrude above the surface of the barrier layer when the barrier layer is applied at a desired coating weight.

The barrier coating may include from about 40 to 750 parts of the binder system per 100 parts pigment by weight. Depending on the pigment(s) used, the dried film CPVC of the barrier coating will generally be about 50-70%, e.g., about 55-65%, by volume, depending on the pigment and binder system used. The barrier coating is formulated so that the PVC in the wet film of the barrier coating will be significantly below the CPVC (e.g., from about 5 to 55%, by volume, in some cases from about 15 to 30%). This allows some of the binder to be absorbed into the substrate, and causes the resulting dried PVC to still be below the CPVC so that the binder will form a continuous film. The degree to which the PVC needs to be below the CPVC will depend on the porosity of the substrate, with more porous substrates requiring a lower PVC to account for absorption of the binder into the substrate.

In order to provide the desired low PVC, in some implementations the barrier coating contains from about 40 to 500 parts latex and from 25 to 250 parts starch, based on 100 parts pigment.

Optional additives that may be included in the barrier coating include lubricants, dispersing agents and agents for viscosity control, pH control, microbiological control, water retention, foam control, and shade and brightness control.

In some implementations, the barrier coating may also include calcium stearate at an additive level, e.g., from 0.01 to 2 parts, preferably 0.05 to 1 parts. Calcium stearate may enhance runnability of the barrier coating on the underlying precoat or substrate by altering the rheology of the barrier coating. Calcium stearate may also improve the grease resistance of the barrier coating.

Topcoat

The topcoat is provided over the barrier coating to avoid blocking while the coated sheet is being wound on the reel on the machine. (It is optional on the non-barrier side, since it is the barrier layer that can cause blocking). The topcoat also provides printability and glueability and tends to enhance the grease/oil resistance of the paper product.

The topcoat that is to be used over the barrier coating needs to be runnable over and compatible with that layer, which is a challenge due to the difficulty inherent in adhering to the barrier coating—essentially a very smooth polymeric film with only a low level of pigment. If contact metering is used, the topcoat must be designed to minimize scratches, drags and streaks. Non-contact metering generally does not have these issues. Both types of metering have compatibility issues, such that if the topcoat does not adequately adhere to the barrier coating the result may be skip coat and/or reticulation of the topcoat during application, and/or cracking/flaking when the paper product is rolled up or folded. The topcoat that is applied to the opposite side of the substrate (if a topcoat is used on this side) does not need to meet this stringent runnability and compatibility requirements, and thus can have a different formulation if desired. For example, any conventional topcoat may be used. The remainder of this section will refer to the characteristics and formulation of the topcoat that is applied to the barrier layer.

The topcoat includes a latex and a pigment blend. Optionally, the topcoat may include a natural binder, and/or small amounts of graphic and board coating additives to enhance printability and runnability. In some implementations, in addition to good runnability over the barrier coating the topcoat exhibits good glueability, foldability, convertability, fiber tear, and lack of curling. Some preferred coatings exhibit "self-healing" properties, such that streaks, drags and scratches that are present after application of the coating will fill in during or before drying of the coating, and/or are easy to calender to remove any remaining flaws.

The latex may be the same as or different from the latex(es) used in the precoat and barrier coatings. In this layer, the latex provides offset printability, e.g., strength and ink setting, and good convertability. In some implementations the latex is also selected to have sufficient flexibility to provide the paper product with good foldability. While the same latex may be used as is used in the barrier coating, in some cases it may be desirable to select a different latex in order to provide enhanced printability. Such latexes may in some cases have a higher $T_g$ and/or storage modulus than those used in the barrier coating. Other suitable latexes include styrene acrylics, styrene acrylates, styrene butadienes, styrene butadiene acrylonitriles, styrene butadiene acrylates, styrene acrylate acrylonitriles, polyvinyl acetates, vinyl acetate ethylenes, and mixtures thereof.

The natural binder, if included, provides water holding, runnability, and printability. Suitable natural binders include starch, proteins, carboxymethyl cellulose, carboxymethyl starch, alginates, and mixtures thereof. Having too much natural binder can impact foldability, ink set time, and water holdability; too little can compromise the properties that the natural binder is used to impart.

The topcoat may also include polyvinyl alcohol (either synthetically or naturally derived) to provide flexibility and repulpability. Polyvinyl alcohol may be used in addition to the latex and starch or it may replace the latex and/or the starch.

The pigment blend is formulated to provide coater runnability of the topcoat over the barrier layer, by providing rheology control and water holding and enhancing the adhesion of the topcoat to the barrier coating. The pigment blend also contributes to good offset printability, including providing good ink gloss by helping to control ink setting and drying. Preferably the pigment blend has a relatively wide particle size distribution with relatively finer pores to retain water for runnability, with blockier pigments (lower aspect ratio) generally enhancing runnability. For example, the pigment blend may include 0 to 50 parts of ultrafine clay and/or an ultrafine ground calcium carbonate. Hydragloss® 90, commercially available from KaMin LLC, and Kaofine 90, commercially available from Thiele, are examples of ultrafine clays. Hydrocarb® HG, commercially available from Omya, and Carbital™ 95, commercially available from Imerys, are examples of ultrafine ground calcium carbonates.

The pigment blend can also include 5 to 100 parts of coarser pigments such as ground calcium carbonate, platy clay or precipitated calcium carbonate (PCC). Suitable rhombohedral and aragonite forms of PCCs typically used in coating formulations are commercially available from Specialty Minerals Industries, Imerys and Omya. For example, Hydrocarb® 90 and Carbital™ 90, ground calcium carbonates, each have a particle size distribution in which 90% of the particles are finer, or smaller, than 2 The ratio of the finer pigment to the coarser pigment may be, for example, from about 1:10 to 10:1, with the ratio depending on the particle sizes and particle size distributions of the pigments used.

In some implementations, the topcoat contains from about 5 to 20 parts latex and from 0 to 10 parts starch or other natural binder per 100 parts pigment. If all natural binder is used, the topcoat can contain up to 20 parts natural binder per 100 parts pigment. Thus, the PVC of the topcoat is generally above the CPVC, e.g., by at least 10%, e.g., the PVC is from about 75% to 90%, to achieve non-blocking during manufacturing. In most formulations having the PVC above the CPVC contributes to providing the surface of the paper product with good printability and glueability and preventing blocking during manufacturing.

Additives may be included in the topcoat to enhance calenderability, printability, and runnability of the topcoat. For example, the topcoat may include calcium stearate at an additive level. Such additives are well known to those of skill in the art.

Substrate

The substrate may be any desired type of substrate used in paper products. In some cases, the substrate has a caliper of from about 4 to 30 points. The substrate used will depend on the characteristics desired in the end product. For example, the barrier systems described herein can be adapted for use with a wide range of substrates, including both heavy weight paperboards and papers such as those used in food wraps.

The substrate can be a web composed of a fiber-based material known to those skilled in the art of manufacturing coated paper and paperboard products. The basis weight of suitable substrates before application of the coating layers typically ranges from about 60 to 460 g/m$^2$ for paper and paperboard products. Preferably the ash content of the substrate, i.e., the amount of inorganic material incorporated within the substrate, including virgin pigment material and pigment material derived from a recycled fiber component of the substrate, is about 2 to 20% by weight, more preferably about 12 to 15% by weight.

The substrate needs to be smooth enough and have sufficiently low enough porosity for the barrier layer to be retained on the paper surface so that the barrier layer will form a continuous film. A standard paper substrate usually has a high degree of surface roughness and is quite open, i.e. very porous. Addition of a precoat layer over the paper substrate provides some degree of smoothness and density to the paper surface. Precalendering of the precoat layer with a temperature and pressure selected to augment the paper surface smoothness and porosity enhances the ability of the barrier layer to form a continuous film. This added smoothness and density may also help in reducing the thickness of barrier layer needed to attain desired barrier properties.

Additionally, the precoat layer may not be needed if the paper substrate itself is made smooth and dense enough by precalendering.

If a precoat is used, the surface roughness of the substrate is not overly important, as the precoat will provide a sufficiently smooth surface to allow the barrier layer to form a continuous film.

If the precoat is to be omitted, the substrate should have a relatively smooth surface (sufficiently smooth to allow a continuous film of the barrier coating to be formed at a desired coating weight of barrier coating). For example, suitable substrates for direct application of the barrier coating would include supercalendered, highly filled substrates having a Parker Print Surf $S_{10}$ roughness of <5.0 μm, preferably <2.5 μm.

Process

The coatings described above can be applied by a variety of coating technologies. Examples of coating applications include bent blade, bevel blade, rod, short dwell, curtain coating, air knife, metered size press, etc. In some implementations the coatings are applied using bent blade or curtain coating equipment. For application of the barrier coating, contour coating (e.g., air knife or curtain coating) may be helpful for obtaining a uniform thickness. Bent blade is most useful for high speed applications while still giving a contour-like application. Practitioners skilled in the art will know that the invention is not limited to these techniques. In addition, those skilled in the art know that modifications to the rheology of the coating compositions of the invention will be necessary depending on the coating technique employed.

Suitable coating weights will depend on a variety of factors, as would be understood by those of skill in the art. However, in some implementations the following coating weights (per side) may be used: precoat: about 3 to 21 grams per square meter ($g/m^2$); barrier coating: needs to be thick enough to provide a continuous film and to act as a grease and oil barrier, e.g., a minimum of 2 to 3 μm thickness in the thinnest part of the barrier layer; topcoat: enough to provide a continuous layer that is thick enough to prevent blocking and print well, but thin enough not to crack, e.g., about 4.5 to 15 $g/m^2$. It is noted that the coating weights of the precoat and the barrier layer will depend on the characteristics of the underlying substrate or layer, with more of the coating being required if the underlying layer is rougher.

Process parameters should be adjusted so that the barrier coating does not film over before it has dried, and so that print mottle and fines and/or soluble binder migration are minimized in the topcoat. Fines that may migrate to the surface of a coating layer are materials typically less than about 0.2 μm in size. Calendering may be used to eliminate or minimize streaks/drags/scratches that are present after contact metering.

When applying the precoat and the barrier layers it is generally desirable to minimize pressure pulses to the coating (e.g., by using non-contact coating methods) during application to get maximum holdout with thinner coating layers.

It is noted that the paper products may be manufactured using a continuous in-line process on one machine, or manufactured on multiple machines. The latter processing may be used, for example, to apply more layers of coating than can be accomplished on a single machine.

Properties

In some implementations, the paper products disclosed herein exhibit the following properties:

| Property | Value (Range or min/max) | Test procedure |
|---|---|---|
| Curl | ≤8 mm | See below |
| RP2 Test, creased (barrier properties) | ≤10%, preferably ≤5% stained | See below |
| Canola Test, creased (barrier properties) | ≤10%, preferably ≤5% stained | See below |
| Blocking (during manufacture) | ≤2 | See below |
| Glueability | ≤5 minutes | See below |
| Repulpability | ≥95%, preferably ≥99% | Fiber Box Association Repulpability Test, Appendix A |

Curl Test: The curl test is performed on 25"×38" sheets of paper or paperboard that are (1) printed on an eight color press printed with the standard 4 colors in standard sequence (Black-Cyan-Magenta-Yellow), (2) overcoat printed in the sixth unit using a typical amount of aqueous overcoat of choice, and (3) heat dried on press. Approximately 10 sheets are pulled during the press run when the press is in steady state. The sheets are allowed rest in a pile for 30 minutes, printed side facing up, in standard press room conditions. One sheet is randomly removed from the pile and placed, printed side up, on a flat surface. Curl is measured at each corner and the four measurements (mm) are averaged. The test is repeated on a second randomly selected sheet. The average of the measurements for the two sheets are recorded.

Curl ratings: ≤4 mm=excellent; ≤8 mm=good; ≤12 mm=acceptable; >13 mm=fail/unacceptable.

RP2 Test, Creased: The RP2 test is based on the RALSTON-PURINA test developed by Ralston-Purina Company for testing pet food packaging materials. A 4"×4" sample of paper is creased in the machine direction and then in the cross-machine direction using a weighted roller. The creased sample is placed on grid paper that is in turn placed on blotter paper in a metal tray. The intersection of the creases should line up with the center of the grid paper. A metal ring 2.5" in diameter and 0.5" high is centered over the center of the creases. Five grams of sand are poured in the center of the creases, ensuring that the sand is evenly distributed. Red dyed synthetic oil (1.1 ml, supplied from Ralston Purina Company) is applied evenly to sand. The sample is placed in an oven at 140° F. (60° C.) for 24 hours. After the grid paper is evaluated for staining. Each square of the grid paper represents 1% of the tested surface area of the sample. The RP2 test result is the total amount of staining based on the number of stained grid squares (e.g., 2 stained squares means a RP2 test result of 2%).

Canola Test, Creased: The Canola test is based on the TAPPI T-454 om-15 Turpentine test and is very similar to the RP2 test but uses an oil widely used in the food industry. The test follows the procedure described above for the RP2 test with the following deviations. The oil used in the test is 1.3 ml of canola oil. The sample is placed in an oven at 60° C. for hour. The Canola test result is the total amount of staining based on the number of stained grid squares (e.g., 2 stained squares is a Canola test result of 2%).

Blocking Test: The following procedure is used to evaluate the tendency of paperboard to 'block' coated surface to uncoated surface. Coated boards are conditioned in the standard TAPPI lab conditions (73° F., 50% RH) for at least 24 hours. Then pairs of 2"×2" pieces of board are stacked coated side-to-uncoated side and clamped at 100 psi in the Koehler jig and placed in a dry oven at 50° C. (122° F.). After 24 hours the test pairs are released from the clamp, evaluated by the rating scale below for the degree of ease with which they separate, and observed for any damage to the surfaces after separating.

Blocking Evaluation Scale

1=No sticking (pieces slide apart unaided)

2=Some sticking, no coated surface disruption (audible pop when manually separated)

3=Ink transfer; coated surface disruption

4=Some fiber tear

5=Welded together (cannot be separated)

Glueability Test: Two strips, each approximately 60 mm×250 mm, are taken from a paper or paperboard sample. A water-based glue is applied to the more porous side of one of the strips using a 19 μm applicator bar (e.g. 0.75 mil Bird bar from BYK Instruments). The glue can be, for example, SwiftTak 48695 available from H.B. Fuller, or Adhesive 8272R available from Cattie Adhesives. The less porous side of the second strip is placed against the glued side of the first strip. This sandwich construct is rolled lightly with a Brayer roller, and then placed under a 2 Kg weight. At 30 second intervals, a short section of the sandwich is quickly pulled apart and evaluated for failure. If the sample pulls apart within the glue layer, the glue has not set. If there is substantial tearing of fiber from one or both of the strips, e.g., more than 50% of a strip, the glue has set, indicating that the two strips have bonded together sufficiently for further use. Results are reported as time to set; any set times less than or equal to 5 minutes are considered "passing" for most applications.

Example

A paper machine trial was conducted to manufacture fluorochemical-free grease resistant paperboard product, as depicted in FIG. 2B. The paperboard substrate had a caliper of 14 points. A precoat was applied to both sides with approximately 9.6 g/m$^2$ on the barrier coating side and 5.4 g/m$^2$ on the opposite side. The coat weights in this example were measured by the paper machine online measurement gauge and therefore are estimated weights. The precoated substrate was dried and precalendered online to provide a smooth surface for the barrier coating.

A barrier coating was applied at various coat weights, detailed below, on the side with the heavier precoat layer.

A topcoat was applied to both sides with approximately 6.0 g/m$^2$ on the barrier coating side to minimize blocking of the barrier coating layer in the reel and 13.3 g/m$^2$ on the opposite non-barrier side to provide desirable printing properties. The non-barrier side of the coated paperboard was calendered.

Coating Formulations (dry parts by weight based on 100 parts of pigment):

| Coating Material | Precoat | Barrier Coat | Topcoat |
|---|---|---|---|
| Platy Clay | 60 | 0 | 20 |
| Fine Ground Calcium Carbonate | 20 | 100 | 5 |
| Coarse Ground Calcium Carbonate | 20 | 0 | 5 |
| Precipitated Calcium Carbonate | 0 | 0 | 50 |
| Ultrafine Ground Calcium Carbonate | 0 | 0 | 20 |
| Latex A (FIG. 5) | 0 | 148 | 0 |
| Styrene Acrylic Latex | 15 | 0 | 12.5 |

-continued

| Coating Material | Precoat | Barrier Coat | Topcoat |
|---|---|---|---|
| Starch | 6 | 74 | 2 |
| Calcium Stearate | 0 | 0.11 | 0.20 |
| Polyvinyl Alcohol | 0 | 0 | 0 |

Several fluorochemical-free grease resistant paperboard products were produced in this manner at a few barrier coat weights. The paperboard products were tested as shown in the Table 1 below. Certain tests were conducted on the paperboard before printing; other tests were performed on the printed paperboard on the non-barrier side.

TABLE 1

| Tests | Condition 1 | Condition 2 | Condition 3 |
|---|---|---|---|
| Barrier Coat Weight (g/m$^2$) | 11.8 | 14.8 | 16.3 |
| Unprinted Paperboard: | | | |
| Caliper (points) | 15.0 | 15.2 | 15.0 |
| Blocking | 1 | 1 | 1 |
| Repulpability | >99% | >99% | >99% |
| RP2 Test, Creased (%) | 26 | 7 | 1 |
| Canola Test, Creased (%) | 4 | 1 | 1 |
| Printed Paperboard: | | | |
| Curl (mm) | 1 | 0 | 0 |
| Glueability (minutes) | 1 | 1 | 1 |
| Paper Gloss, 75 Degree[1] | 62.4 | 62.6 | 63.3 |
| Parker Print Surf $S_{10}$ Roughness[2] (μm) | 1.11 | 1.18 | 1.03 |
| Backtrap Mottle (BTM) | 3.0 | 3.0 | 3.0 |
| Rate of Ink Tack Build-Up[3] | 9.0 | 10.1 | 10.1 |
| Ink Gloss, 20 Degree[4] | 33 | 35 | 37 |

Notes:

[1]TAPPI T-480 om-15

[2]TAPPI T-555 om-15

[3]Lodcel test as described in TAGA 1992 Proceedings: Concannon, Paul W., Wilson, Larry A. (1992). A method for measuring tack build of offset printing inks on coated paper. In TAGA (Ed.) Technical Association of the Graphic Arts TAGA 1992 Proceedings (pp.282-301). Rochester, NY: TAGA.

[4]TAPPI T-653 om-07

TAPPI Standard Methods are well known to those in the art.

Lodcel Test. The lodcel test was developed by S.D. Warren Company in 1974, refined over the years and published at TAGA proceedings in 1992. The lodcel test measures the force to split an ink film between a printing blanket and paper (g/cm$^2$/sec). The process is designed to give an indication of how a given paper and ink combination may react when subjected to the stresses of multiple printing impressions. To perform the lodcel test, a Vandercook proofing press is used. A measured layer of ink is applied to the block (length 12", depth 0.003") by a scraper, and the blanket is run over the block to split the ink film. The paper sample (2½"×10") is placed in clamps and then printed using the blanket. Every 7 seconds, the press passes over the sample (speed 100 ft./min) and the force is recorded until failure occurs (ink force at failure point) or 10 passes have passed, whichever comes first. Failure is when coating is picked from the paper surface by the force of the ink tack. The ink forces for the first and last passes are omitted and the slope (rate of ink tack build-up) is calculated based on the ink forces for the other passes.

Backtrap Mottle Test: In multi-color offset printing, tack build-up of inks is important both to ink-setting and to the transfer of additional ink film to the fresh ink layers already on the paper. Part of the fresh ink already on the paper may retransfer or "backtrap" to subsequent printing blankets. If the tack build-up is not uniform over the paper surface, the local transfer/retransfer balance is upset and the resulting print will not be uniform and may appear mottled. This partial or uneven setting of the ink on a microscale is referred to as "backtrap mottle" (BTM), and can result in an unacceptable blotchy or mottled printed surface with alternating light and dark printed areas. The size of the light and dark areas varying in print density are a distinguishing characteristic of a given printed substrate. Generally, BTM is more noticeable and objectionable for larger printed areas, smaller halftones, coarser BTM patterns, and larger spacings of the light and dark areas. BTM can be measured by commercially available instruments or by subjective expert evaluation.

Backtrap Mottle Scale: 1=No visible BTM; 2=Very slight BTM; 3=Slight BTM; 4=Moderate BTM; 5=Severe BTM; 6=Very severe BTM.

OTHER EMBODIMENTS

A number of embodiments have been described. Nevertheless, it will be understood that various modifications may be made without departing from the spirit and scope of the disclosure.

Accordingly, other embodiments are within the scope of the following claims.

What is claimed is:

1. A paper product comprising:

a substrate; and on at least one side of the substrate, a continuous layer of a barrier coating, the barrier coating comprising a binder system, the binder system comprising a latex and a natural binder, and a pigment, wherein the barrier coating, when applied to the substrate and dried to form a barrier layer, has a Pigment Volume Concentration (PVC) that is below a Critical Pigment Volume Concentration (CPVC) of the barrier coating, providing a continuous three-dimensional film of the binder system.

2. The paper product of claim 1, further comprising a topcoat disposed on the surface of the barrier layer.

3. The paper product of claim 2 wherein the topcoat has a PVC that is above a CPVC of the topcoat.

4. The paper product of claim 2 wherein the topcoat includes a pigment blend comprising an ultrafine clay and/or an ultrafine ground calcium carbonate.

5. The paper product of claim 2 wherein the topcoat comprises a natural binder.

6. The paper product of claim 1 wherein the barrier coating includes from about 40 to 750 parts of the binder system per 100 parts pigment by weight.

7. The paper product of claim 1 wherein the paper product exhibits >99% repulpability.

8. The paper product of claim 1 further comprising a precoat disposed between the substrate and the barrier layer.

9. The paper product of claim 8 wherein the precoat includes a pigment blend comprising a platy pigment and a coarse pigment with an average particle size of at least about 2 μm.

10. The paper product of claim 8 wherein the precoat is calendered.

11. The paper product of claim 1 wherein the paper product is free of fluorocarbon-containing materials.

12. The paper product of claim 1 wherein the binder system includes from about 2 to 250 parts of polyvinyl alcohol.

13. The paper product of claim 1 wherein the binder system includes from about 0.01 to 2 parts of calcium stearate.

14. The paper product of claim 1 wherein the storage modulus on the TMA (thermomechanical analysis) curve of the latex is less than 50 MPa at room temperature (25° C.).

15. The paper product of claim 14 wherein the storage modulus on the TMA curve of the latex is less than 30 MPa at room temperature (25° C.).

16. A paper product comprising:

a substrate;

on at least one side of the substrate, a continuous layer of a barrier coating, the barrier coating comprising a binder system and a pigment, and a topcoat disposed on a side of the barrier coating opposite the substrate, wherein the barrier coating, when applied to the substrate and dried to form a barrier layer, has a Pigment Volume Concentration (PVC) that is below a Critical Pigment Volume Concentration (CPVC) of the barrier coating, providing a continuous three-dimensional film of the binder system.

17. The paper product of claim 16 wherein the topcoat includes a pigment blend comprises ultrafine clay and/or an ultrafine ground calcium carbonate.

18. The paper product of claim 17 wherein the topcoat further comprises a coarse pigment.

19. The paper product of claim 18 wherein the ratio of fine pigment to coarse pigment is from about 1:10 to 10:1.

20. The paper product of claim 16 wherein the topcoat includes a binder system comprising a latex.

21. The paper product of claim 20 wherein the topcoat binder system further comprises a natural binder.

22. The paper product of claim 21 wherein the natural binder comprises starch.

23. The paper product of claim 16 further comprising a precoat disposed between the substrate and the barrier coating.

24. The paper product of claim 23 wherein the precoat is calendered.

25. A method of making a paper product comprising:

applying, to at least one side of a substrate, a continuous layer of a barrier coating, the barrier coating comprising a binder system, the binder system comprising a latex and a natural binder, and a pigment, drying the barrier coating to form a barrier layer, the dried barrier layer having a Pigment Volume Concentration (PVC) that is below a Critical Pigment Volume Concentration (CPVC) of the barrier coating, providing a continuous three-dimensional film of the binder system, and applying a topcoat to the barrier layer.

26. The method of claim 25, wherein the topcoat is a graphical topcoat.

27. The method of claim 26 further comprising calendering the topcoat.

28. The method of claim 25 further comprising applying a precoat to the substrate prior to applying the barrier coating, on the same side of the substrate.

29. The method of claim 25 wherein applying the barrier coating is performed using a non-contact coater.

30. The method of claim 28 further comprising calendering the substrate after applying the precoat and before applying the barrier coating.

31. The method of claim 25 further comprising calendering the substrate prior to applying the barrier coating.

* * * * *